US005708257A

United States Patent [19]

Comarteau et al.

[11] Patent Number: 5,708,257

[45] Date of Patent: Jan. 13, 1998

[54] HEATING DEVICE FOR TRANSFER OF LIQUID METAL AND PROCESS FOR MANUFACTURING THE DEVICE

[75] Inventors: Jean-Louis Comarteau, Chatenoy de Royal; Daniel Boudot, Saint-Remy; Alain Remy, Chalon-sur-Saone; Patrice Nykiel, Beaumont-sur-Crosne, all of France

[73] Assignee: Seva, Chalon-sur-Saone, France

[21] Appl. No.: 495,623

[22] PCT Filed: Feb. 7, 1994

[86] PCT No.: PCT/FR94/00139

§ 371 Date: Sep. 26, 1995

§ 102(e) Date: Sep. 26, 1995

[87] PCT Pub. No.: WO94/17938

PCT Pub. Date: Aug. 18, 1994

[30] Foreign Application Priority Data

Feb. 8, 1993 [FR] France ..... 93 01497

[51] Int. Cl.[6] ..... H05B 6/36

[52] U.S. Cl. ..... 219/674; 29/611; 29/DIG. 46; 373/160; 392/479

[58] Field of Search ..... 29/611, DIG. 46; 219/535, 602, 647, 674, 676; 373/142, 160–162; 392/473, 478, 479, 480; 266/252

[56] References Cited

U.S. PATENT DOCUMENTS

| | | | |
|---|---|---|---|
| 3,604,598 | 9/1971 | Kappmeyer et al. | 222/146 |
| 4,161,647 | 7/1979 | Carbonnel | 392/473 |

FOREIGN PATENT DOCUMENTS

| | | |
|---|---|---|
| 0103220 | 3/1984 | European Pat. Off. . |
| 0379647 | 10/1989 | European Pat. Off. . |
| 0407786 | 1/1991 | European Pat. Off. . |
| 2532866 | 3/1984 | France . |
| 2670697 | 6/1992 | France . |

*Primary Examiner*—P. W. Echols

*Attorney, Agent, or Firm*—Sughrue, Mion, Zinn, Macpeak & Seas, PLLC

[57] ABSTRACT

A heating assembly 1 for transferring liquid metal 28 has a closed cross-section and includes a refractory tube 4 wrapped in an insulating layer 5 which is in turn surrounded by an inductor 3 enclosed in refractory concrete within a metal shell, the insulating layer 5 consisting of an insulating refractory concrete layer 5a. The heating assembly 1 may be used in a liquid metal holding furnace 9 provided with a supply of pressurised gas Pr for producing metal parts.

9 Claims, 4 Drawing Sheets

HEATING DEVICE FOR TRANSFER OF LIQUID METAL AND PROCESS FOR MANUFACTURING THE DEVICE

BACKGROUND OF THE INVENTION

The invention under consideration relates to a heating device designed for the transfer of liquid metal, said device having a closed transverse section. The invention concerns, first, a process for manufacture of a device of the aforementioned type terminating at one end in a pouring orifice serving to feed at least one mold, and of the type comprising over its entire length at least one heating apparatus formed by a coil-shaped inductor, through whose turns an alternating electric current circulates.

The metal-transfer heating devices (cf. the tapping spout described in French Patent No. 2 532 866) are especially advantageous for transferring a metal heated to high casting temperature. Said heating devices remove the risk of cooling and solidification of a metal alloy at a casting temperature of at least 1,400° C. in a spout between two successive casting operations.

According to a conventional technique, the spout comprises a graphite susceptor sleeve tube incorporating a right-hand portion and a bent portion.

This configuration is especially advantageous when the casting is carried out discontinuously. Indeed, in this case the liquid metal may not be present in the spout for a relatively long period. It is then helpful to keep the spout preheated for this period of time, a function performed by the graphite. However, when working continuously, as is the case in stabilized production processes involving large or medium-size quantities, this advantage diminishes. In this case, the continuous presence of the liquid metal in the spout, combined with induction heating, keeps the system at the proper temperature. Thus, the graphite is no longer necessary, especially because the initial preheating of the spout, before filling it with liquid metal, can be carried out using an accessory, more flexible and less costly heating system, such as one using gas.

Moreover, the conventional configuration exhibits a number of disadvantages in use associated with the complexity of the manufacture of the spout: i.e., problems related to forming, cutting, and centering. These difficulties increase the spout-manufacturing cost.

SUMMARY OF THE INVENTION

The invention is intended to solve these problems. To this end, the process according to the invention includes the following steps:

- an assembly forming a thermal insulation covering is placed around a refractory ceramic tube, the insulation-covering assembly comprising a layer of refractory insulation concrete and/or at least one layer of a fibrous material,
- shaping of the inductor around and in contact with this assembly,
- centering of the assembly surrounded by the inductor in a metal jacket,
- filling the space between the inductor and the metal jacket by pouring refractory concrete while generating vibrations thereon,
- after the concrete hardens, baking of said metal-transfer heating device.

According to certain characteristics the process includes one or several steps involving cutting and/or assembly of the refractory tube.

The layer of insulating material (refractory concrete and/or fibrous material) has the advantage of supplying good thermal insulation of the tube and the metal during use.

The fibrous layers provide a higher level of insulation than do refractory concretes and strengthen the insulation.

Furthermore, the insulating layer gives additional protection in the event of wear and/or cracking of the ceramic tube in contact with the liquid metal, thereby lessening the risks of infiltration of liquid metal into the winding and increasing safety.

Heating and temperature-maintenance of the liquid metal contained in the refractory spout are provided by the inductor, through which an alternating current circulates at medium or high frequency. This heating method allows direct transfer of electrical energy, in the form of thermal energy, to the liquid metal. Since no intermediate element, such as graphite, is used, the energy transfer is direct and yield is enhanced. The frequency passing through the inductor falls, typically, within the range 1,000–15,000 hertz.

The invention also concerns a heating device for transfer of liquid metal. This device, which has a closed transverse cross-section, extends upward and ends, on its upper face, in a pouring or outlet orifice used to feed at least one mold, and is of the type comprising over its entire length at least one heating mechanism formed by a coil-shaped inductor through whose turns an alternating electric current circulates. Said device may be manufactured using the process according to the invention and incorporates a refractory tube surrounded by an assembly forming an insulating covering, which is, in turn, surrounded by an inductor enclosed in refractory concrete contained in a metal jacket, the insulation thickness being formed by a layer of an insulating refractory concrete.

The insulation covering may comprise at least one layer of a fibrous material.

The device is a self-contained element that can be changed on a cupola furnace when the device reaches the end of its useful life, or, less frequently but feasibly, when the furnace itself reaches the end of its life.

To clean the device and reduce bulk, the device forms a spout having an axis incorporating a constant radius of curvature or a rectilinear axis.

To produce a liquid metal-tight junction while being able to replace the device in a manner suited for industrial-scale use when personnel work two or three eight-hour shifts in succession. At its point of contact with the furnace, the device comprises an external collar drilled with holes straight through, on which a ring is fitted so as to work in conjunction with the metal jacket. The refractory portions of the device are extended toward and at the furnace by a ring-shaped joint made of chemically-hardened refractory concrete, which is, in turn, extended by a second joint made of a fibrous material.

The joint is made by clamping the device to the wall of the furnace, thereby crushing two joints of excess thickness in the refractory areas of the device and the oven. This joint may be used on relatively hot furnaces; eight hours of cooling are sufficient.

Only a few small repairs of the furnace refractory are required when the device is changed.

In a variant, the device according to the invention is extended at its mold-feeding end by a refractory tube having a hollow, cylindrical shape, the outer wall of the sleeve tube working in conjunction with the inner, hollow cylindrical wall of a collar by means of compressed concrete.

BRIEF DESCRIPTION OF THE DRAWINGS

Embodiments, applications, and uses of the invention will now be described with reference to the attached drawings, in which.

DETAILED DESCRIPTION OF THE PREFERRED EMBODIMENT

Figures 1A, 1B:
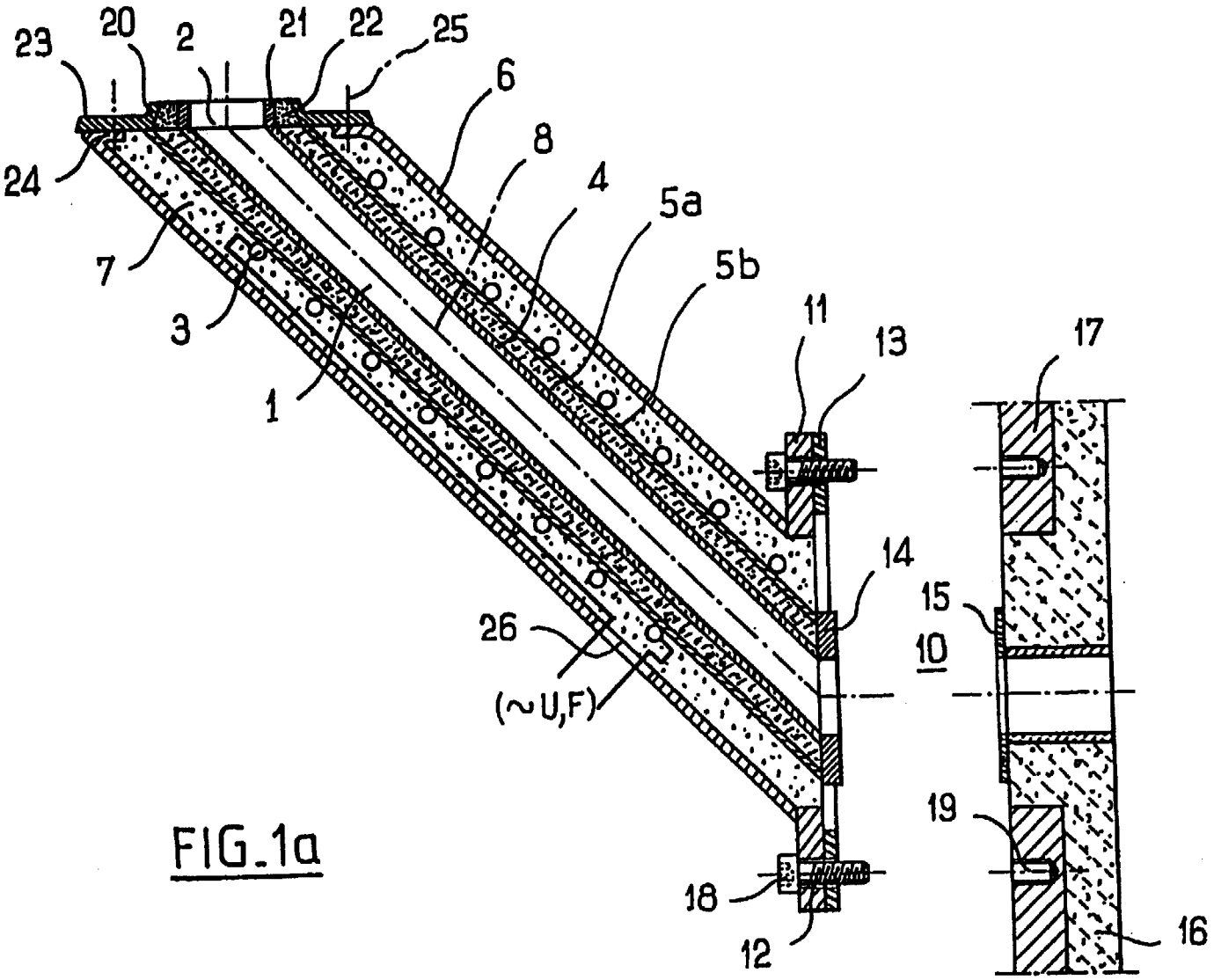
FIGS. 1*a* and 1*b* are vertical cross-sections of a heating device according to the invention.

The device illustrated in FIG. 1 is a liquid metal-transfer heating device. This device 1, which has a closed transverse section, has a rectilinear axis 8.

The heating device having axis 8 is constituted by a refractory tube 4, an assembly 5 forming a thermally-insulating covering made of a layer of insulating refractory concrete 5*a* surrounded by a layer of a fibrous material 5*b*, an inductor 3, refractory concrete 7, and an outer metal jacket 6. All of these elements 3, 4, 5, 5*a*, 5*b*, 6, and 7 have a substantially hollow, cylindrical shape. The end of the device 1 is horizontal and incorporates an orifice 2. The metal jacket 6 has a horizontal, annular flange or bulge 24 in its upper part, so as to cover partially the refractory concrete 7. The jacket 6 has a hole 26 cut radially in its lower part and opening downward. The lower part of the jacket 6 ends in an outer radial protuberance forming a vertical, annular collar 11 incorporating holes 12 in which attachment screws 18 are inserted.

The inductor 3 is formed by helical turns of a copper tube surrounding the insulation covering 5 and embedded in the refractory concrete 7. Each end of the metal tube forming the coil is brought to the location of the hole 26 and extends outward from the heating device 1, so as to form electrical connections with the medium- or high-frequency current generator. The horizontal end surface of the device 1 is extended by means of an intermediate wear piece 23 having a hollow, cylindrical shape, the inner wall of the cylinder having a constant diameter over its height. The outer wall of a sleeve 21, works in conjunction with the inner hollow cylindrical wall of a ring 20 by means of compressed concrete 22.

The height of the sleeve tube 21 is identical to the height of the ring 20. Notches having a vertical axis 25 are provided in the base of the ring 20 to allow the passage of attachment screws on the horizontal end of the jacket 6.

A ring 13 cooperating with the metal jacket 6 fits over the outer collar 11, the refractory parts 4, 5, 7 of the device 1 being extended in the area of and toward the furnace 9 by means of a ring-shaped joint 14 made of chemically-hardened refractory concrete, this joint being, in turn, extended by a second joint 15 made of a fibrous material.

The device 1 is designed to be attached to the framework 17 of the furnace 9, which incorporates threaded recessed holes 19 allowing the attachment and tightening of the device 1 using screws 12, thereby making it possible to compress the joints 14, 15 and the ring 13 and ensuring the impermeability of the unit.

The framework 17 is lined inside the furnace 9 with a refractory covering 16. The furnace 9 comprises a duct which empties outward and is surrounded by the refractory covering.

Figure 2:
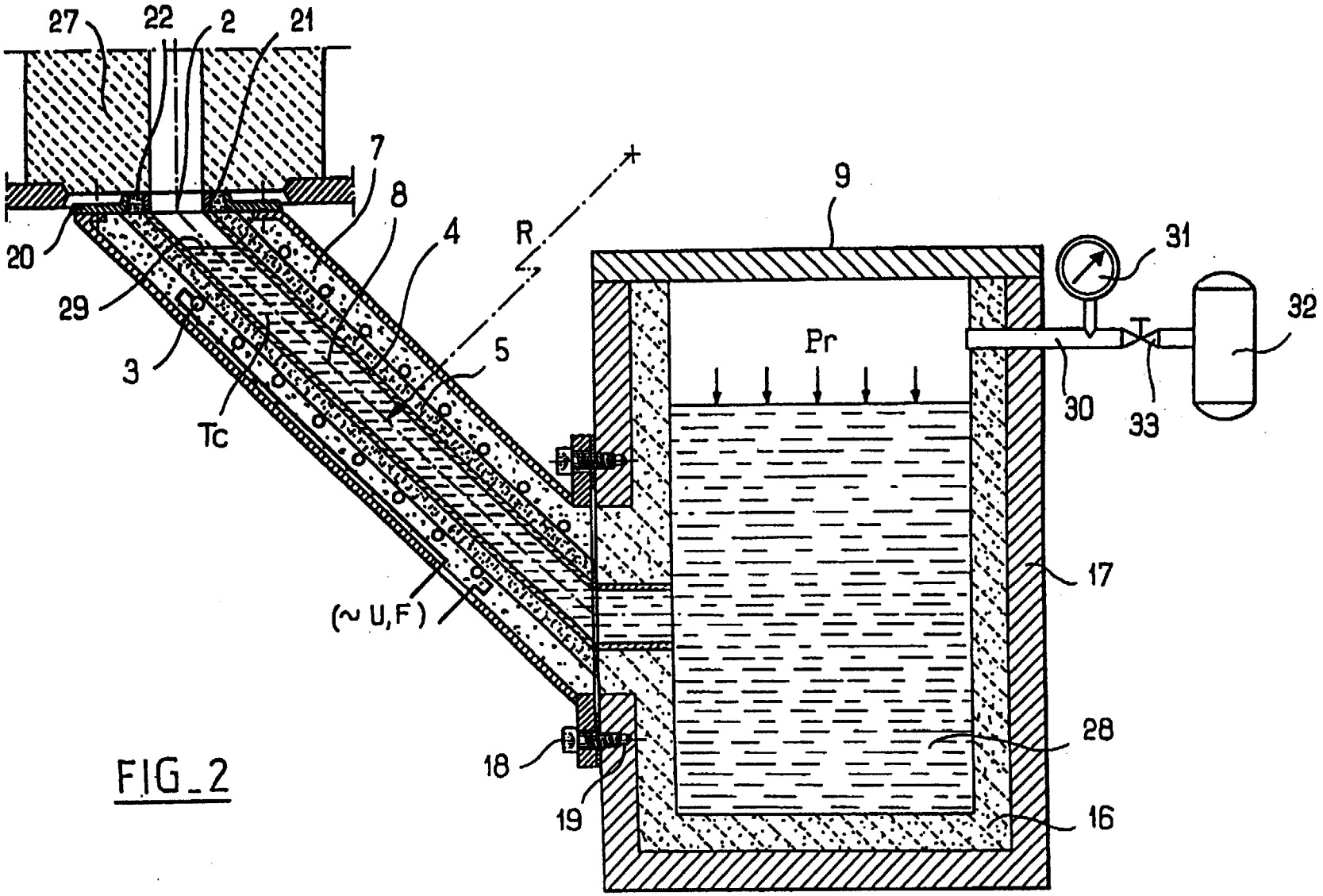
FIG. 2 is a vertical cross-section of a casting apparatus using a heating device according to the invention.

The device is attached in the extension of the duct in order to form the device illustrated in FIG. 2, which shows a casting machine. The heating device 1 differs from that illustrated in FIG. 1, by virtue of the fact that it forms a spout having an axis 8 with a constant radius of curvature R. The numerical references in FIG. 2 correspond to the elements referenced in FIG. 1. In this example, the furnace 9 is closed and impermeable, in order to constitute an airtight casting unit when the mold 27 is placed in the working position at the upper end of the device 1. The furnace 9 contains liquid metal 28 which, under the pressure Pr generated in the upper part of the furnace 9, rises to a level 29 near the upper end of the device 1 in the direction of the mold 27.

This level 29 is higher than the surface of the liquid metal 28 in the mold 9. The gas pressure Pr generated on the metal 28 is produced by a duct 30 emptying inside the upper part of the furnace 9.

The duct 30 draws in air or a gas above the level of the metal bath 28 contained in the furnace 9. The duct 30 is connected to a pressurized gas source 32. A pressure gauge 31 and a valve 33 are mounted on the duct, so as to admit, cut off, and adjust the gas feed to the furnace, thereby making it possible to adjust the height of the metal level 29 in the device 1. Accordingly, the casting machine allows control of the filling of the mold 27 by means of the pressure Pr and production of thin parts or pieces incorporating complex shapes by the pressurized feed Pr of the liquid metal 28 into the mold 27.

The rounding of the spout along the axis 8 reduces the space requirement as compared with a rectilinear duct, and allows the mold 27 to be closer to the furnace 9. The constant radius R makes it possible to avoid the use of a highly-pronounced bend, as used in the conventional configuration. In fact, in this case major heterogenous temperature differences are observed in the bend, these differences being linked to an excess concentration of power in the inner part of the bend, because the turns are closer together at that spot. Temperature heterogeneity produces differences in the integrity of the objects in the mold, but the use of a device incorporating a constant radius of curvature eliminates this effect.

Furthermore, the regularity of the axis 8, whether rectilinear or having a constant radius R, allows the duct to be cleaned with tools, i.e., scrapers, which would be obstructed by a bend. In fact, highly-oxidizable metal alloys produce deposits in the device 1 requiring cleaning, preferably under heat, to avoid obstruction of the device 1.

Moreover, the inductor 3 makes it possible to generate induced currents within the liquid metal 28, thereby producing a stirring effect which promotes the thermal homogenization of the metal.

The magnitude of this stirring effect is controlled by the choice of frequency. Stirring increases in intensity as the frequency is lowered. Low frequencies are also preferable when the refractory tube 4 has a large diameter or when it is desired to limit the problems of infiltration toward the coil of the inductor 3. However, a high frequency is better suited to restricting the turbulence inside the spout, which may produce variations in the integrity of the molded parts (due to bubbles, inclusions, etc.). The choice of frequency in the inductor 3 thus represents a compromise between these different parameters.

Thus, the heating method according to the invention gives high temperature precision in the heating device, by setting the electrical parameters, thereby making it possible, by using the heating device 1, to pour the metal 28 heated to a high melting point, i.e., above 1,400° C. and/or made highly oxidizable, at a temperature that can be regulated with precision. This precise temperature-regulation capacity allows adjustment within very precise ranges. Accordingly, the casting temperature Tc in the spout may approximate the liquidus very closely, without risk of solidifying the metal.

Figure 4:
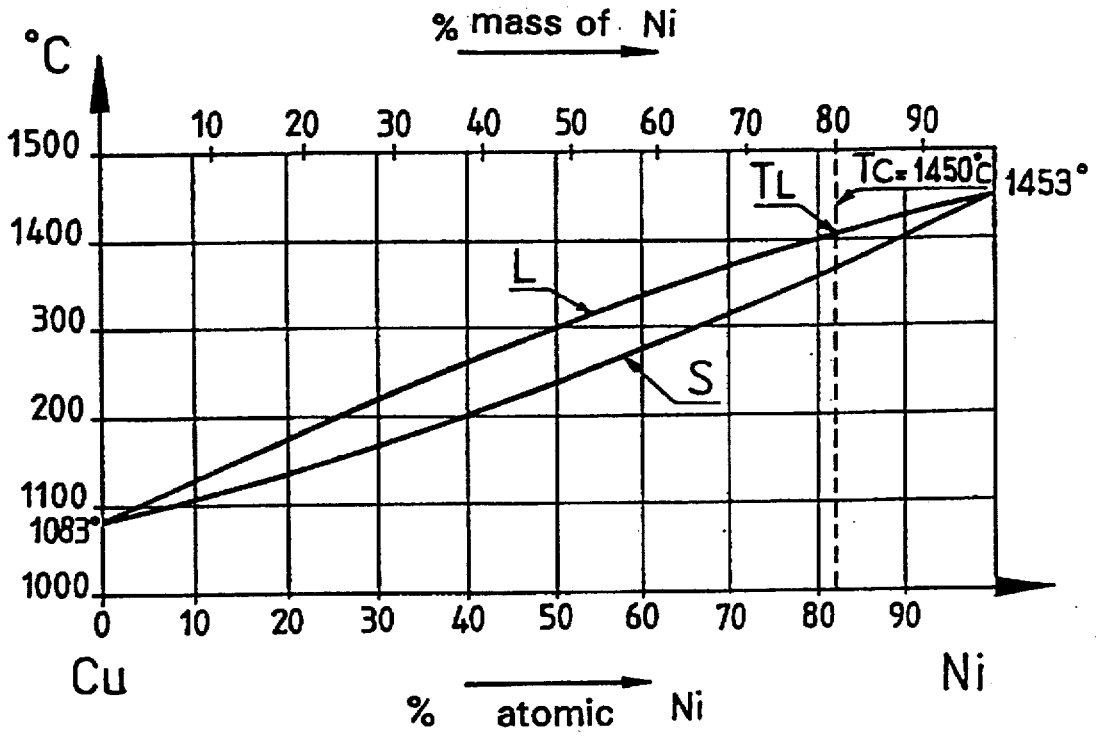
FIG. 4 shows the pouring temperature as a function of voltage using a heating device according to the invention.

The diagram in FIG. 4 represents an equilibrium diagram of a copper-nickel alloy. The upper curve L is called the liquidus, and the lower curve S, the solidus.

The ordinate indicates the temperature in degrees Celsius, and the abscissa, the percentage of copper and nickel. Beginning with a metal composed of 100% copper at the start, the graph ends at a metal composed of 100% nickel. At a temperature above the liquidus L, the metal alloy is liquid. If the temperature is below the solidus S, the alloy will be a solid solution.

Induction heating allows a high degree of temperature precision by means of the electric parameters. Precise adjustment allows work to proceed at relatively low temperatures (e.g., at 50° C. above liquidus).

The example in FIG. 4 shows that it is possible to pour an alloy composed of 80% nickel/20% copper at 1,450° C., at the TC temperature, which is 50° C. above the TL temperature of the liquidus L. This relatively low TC temperature gives a better surface finish to the objects, restricts reactions between the mold and the metal, and yields a crystal size improved by a higher cooling rate. For metals having a high melting point, in which the risk of solidification is very large, induction heating of the device 1 prevents any solidification in the device 1. This heating method is especially advantageous when the metal 28 stays continuously inside the device 1.

The invention can be used for nickel-based superalloys characterized by relatively high TL liquidus L temperatures, which are typically higher than 1,400° C. The invention can also be used for oxidizable alloys or, in a variant, for steels which also exhibit liquidus temperatures greater than 1,400° C., even in the case of heavily alloyed stainless steels.

Advantage is gained in using the invention for the repetitive filling of casting molds 27 using any of the metals 28 specified above, the upper level 29 of the liquid always remaining in the upper area of the heating device 1.

This application makes it possible to prevent the gradual obstruction of the device 1, an occurrence that may result from castings of oxidizable alloys if the pressure P is reduced between two cycles.

Maintaining the metal 28 at a level 29 close to the upper part of the device 1 allows cleaning of the bath between two successive castings. Moreover, because the liquid metal remains near the mold 27, the casting times are shorter and the turbulence generated by movement of the liquid metal 28, dampened. In addition, thermal regulation of the device is improved, thereby limiting the transitory thermal states that can cause variations in the integrity of the objects.

Induction allows reheating of the metal held in the mold 27. It prevents solidification of the metal in the casting well of the mold 27 and of the metal 28 in the upper part of the device 1 during the casting operation. These effects are intensified especially when the casting cycles are long.

Figure 3:
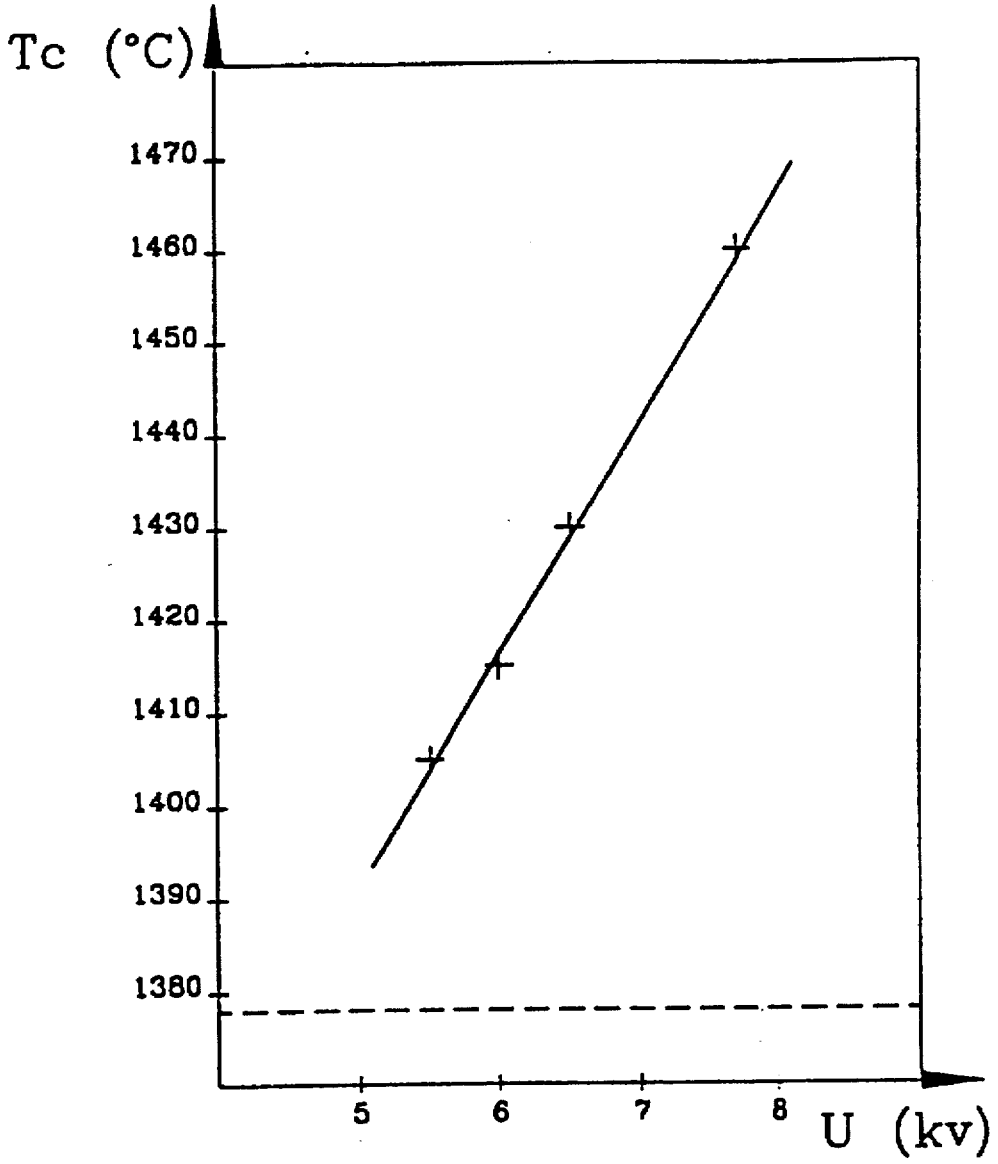
FIG. 3 is an equilibrium diagram of a nickel-copper alloy usable in a device according to the invention.

FIG. 3 is a graph showing temperature adjustment by means of voltage variation at the terminals of the inductor 3.

The abscissa indicates the voltage in kilovolts, and the ordinate, the temperature of the metal.

The horizontal dotted line represents the liquidus temperature measured during the cooling of the alloy at the time of the test. Tests showed that the temperature Tc of the metal in the device was linear and proportionate to the voltage applied at the inductor terminals.

The table below corresponding to the curve in FIG. 3 gives the data recorded. The following abbreviations are used:

U: voltage
F: frequency
TC: temperature
P(KVA): power

| U | F | TC | P(KVA) |
|---|---|---|---|
| 7.7 KV | 11 KHz | 1,460° C. | 26.95 |
| 6.5 KV | 11 KHz | 1,430° C. | 18.2 |
| 6 KV | 11.1 KHz | 1,415° C. | 15.9 |
| 5.5 KV | 11 KHz | 1,405° C. | 13.2 |

We claim:

1. A process for the manufacture of a heating device (1) used for the transfer of liquid metal (28), said device having a closed transverse section and opening at one end into an outlet orifice (2) for feeding at least one mold (27) and comprising over its entire length at least one heating apparatus comprising an inductor coil (3) through whose turns an alternating electric current flows, said process including at least the following steps:

a) forming an assembly comprising a thermal insulation covering (5) surrounding a refractory tube (4), b) coiling an inductor (3) around and in contact with the assembly (5), c) centering the assembly (5) surrounded by the inductor (3) in a metal jacket (6), d) filling the space between the inductor (3) and the metal jacket (6) with refractory concrete (7) poured while generating vibrations thereon, and e) after hardening of the concrete (7), baking the heating device (1) for transfer of the metal (28).

2. A process according to claim 1, wherein the insulation covering (5) comprises a layer of insulating refractory concrete (5*a*) and at least one layer of a fibrous material (5*b*).

3. A process according to claim 1, wherein the alternating electric current feeding the inductor (3) has a frequency of 1,000 to 15,000 hertz.

4. A heating device (1) for the transfer of liquid metal (28), said device having a closed transverse section extending upwardly and opening on an upper face thereof through an outlet orifice (2) for feeding at least one mold (27), and comprising over the entire length thereof at least one heating apparatus comprising an inductor coil (3) through whose turns an alternating electric current flows, said device being manufactured by the process according to claim 1, and comprising: a refractory tube (4) surrounded by an elongated unit forming an insulation covering (5), in turn surrounded by an inductor (3) enclosed in refractory concrete contained in a metal jacket (6), the insulation covering (5) being composed of a layer of refractory insulating concrete (5*a*) and at least one layer of a fibrous material (5*b*).

5. A heating device (1) according to claim 4, wherein said device forms a spout having a constant radius of curvature (R) around an axis (8).

6. A heating device according to claim 5 wherein said axis (8) is rectilinear.

7. A heating device (1) according to claim 4 designed for feeding a mold (27) from a furnace (9) containing liquid metal (28), wherein said device comprises, at a junction (10) with said furnace (9), an outer collar (11) drilled through with holes (12) and on which a ring (13) working in conjunction with said metal jacket (6) is fitted, refractory parts (4, 5, 7) of said device (1) being extended toward and at the furnace (9) by a ring-shaped joint (14) made of a chemically-hardened refractory concrete, in turn extended by a second joint (15) made of a fibrous material.

8. A device according to claim 5, extended at the end thereof for feeding the mold (27), by a hollow, cylindrical refractory sleeve (21), an outer wall of the sleeve being joined to a hollow cylindrical inner wall of a ring (20) by compressed concrete (22).

9. A heating device according to claim 4, coupled to a furnace (9) designed for liquid state maintenance of metal (28), said furnace (9) being fed with pressurized gas (Pr) to push the liquid metal (28) into the mold (27) through the heating device (1).

* * * * *